US007267588B1

(12) United States Patent
Griffiths et al.

(10) Patent No.: US 7,267,588 B1
(45) Date of Patent: Sep. 11, 2007

(54) SELECTIVELY LOCKABLE MARINE PROPULSION DEVICES

(75) Inventors: John M. Griffiths, Fond du Lac, WI (US); Richard A. Davis, Mequon, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/365,175

(22) Filed: Mar. 1, 2006

(51) Int. Cl.
*B63H 5/125* (2006.01)

(52) U.S. Cl. ..... 440/63; 114/172

(58) Field of Classification Search ..... 440/63, 440/53; 114/150, 172
See application file for complete search history.

(56) References Cited

U.S. PATENT DOCUMENTS

| | | | | |
|---|---|---|---|---|
| 3,658,027 A | | 4/1972 | Sturges | 115/18 |
| 4,227,481 A | | 10/1980 | Cox et al. | 440/61 |
| 4,266,497 A | | 5/1981 | Toda et al. | 114/144 R |
| 4,300,888 A | * | 11/1981 | Warning | 440/62 |
| 4,362,117 A | | 12/1982 | Mishina | 114/150 |
| 4,431,422 A | | 2/1984 | Hall | 440/61 |
| 4,578,039 A | | 3/1986 | Hall | 440/61 |
| 4,778,418 A | * | 10/1988 | Mondek | 440/63 |
| 5,755,605 A | | 5/1998 | Asberg | 440/75 |
| 6,234,853 B1 | | 5/2001 | Lanyi et al. | 440/53 |
| 6,406,340 B1 | | 6/2002 | Fetchko et al. | 440/61 |
| 6,431,928 B1 | | 8/2002 | Aarnivuo | 440/58 |
| 6,561,860 B2 | * | 5/2003 | Colyvas | 440/63 |
| 6,623,320 B1 | | 9/2003 | Hedlund | 440/80 |
| 6,712,654 B1 | | 3/2004 | Putaansuu | 440/53 |
| 6,913,497 B1 | | 7/2005 | Ahlswede et al. | 440/63 |

FOREIGN PATENT DOCUMENTS

| | | |
|---|---|---|
| WO | WO 03/042036 | 11/2002 |
| WO | WO 03/093102 | 4/2003 |

OTHER PUBLICATIONS

U.S. Appl. No. 10/873,086, filed Jun. 21, 2004, Lokken et al.
U.S. Appl. No. 11/248,483, filed Oct. 12, 2005, Bradley et al.
U.S. Appl. No. 11/248,482, filed Oct. 12, 2005, Bradley et al.

* cited by examiner

*Primary Examiner*—Ed Swinehart
(74) *Attorney, Agent, or Firm*—William D. Lanyi

(57) ABSTRACT

A steering system for a marine vessel is provided with a connecting link attached to first and second marine propulsion devices. The connecting link is selectively disposable in first and second states of operation which either require synchronous rotation of the first and second marine propulsion devices or, alternatively, independent rotation of the two marine propulsion devices. This allows both marine propulsion devices to be operated by a single actuator or, alternatively, independent maneuvering of the two marine propulsion devices during certain types of docking procedures.

12 Claims, 2 Drawing Sheets

SELECTIVELY LOCKABLE MARINE PROPULSION DEVICES

BACKGROUND OF THE INVENTION

1. Field of the Invention

The present invention relates generally to steering systems for marine propulsion systems and, more particularly, to a steering system which allows two or more marine propulsion devices to be selectively locked in synchrony with each other or, alternatively, be allowed to rotate about their respective steering axes independently from each other.

2. Description of the Related Art

Skilled artisans in the field of marine propulsion devices are familiar with many different types of steering apparatus which are provided for the purpose of causing marine propulsion devices to rotate about steering axes relative to a marine vessel to which they are attached. In some applications, two or more marine propulsion devices are locked to each other so that they rotate in synchrony about their respective axes. In some applications, these steering links can be deactivated to allow auxiliary marine propulsion devices to be independently trimmed or tilted out of the water and, when this condition persists, to be unlinked from a main propulsion device.

U.S. Pat. No. 3,658,027, which issued to Sturges on Apr. 25, 1972, describes a single cylinder hydraulic stabilizer for steering. It serves to lock a steering element in its position at any time valve-actuating rods of the device are not being caused to move as a result of steering forces applied thereto. The valve controls the flow of hydraulic fluid from one end of the hydraulic cylinder to the other end of the cylinder so as to permit movement of the valve block itself with respect to a portion of a vehicle, such as a boat.

U.S. Pat. No. 4,227,481, which issued Cox et al. on Oct. 14, 1980, describes a safety steering system for outboard motors. The system controls torque rotation for boats having directable marine outboard motors capable of pivoting about a vertical axis. An arm extending from the motor is connected to a flexible cable having two ends, a first end connected to a steering device and a second end connected to the arm. An actuator control valve interposed along the flexible cable is capable of locking the arm in a single position when no force from the cable is being exerted on the arm.

U.S. Pat. No. 4,266,497, which issued to Toda et al. on May 12, 1981, describes a marine steering arrangement which includes a hydraulic steering machine, variable discharge-type pump units for actuating the hydraulic steering machine and power units for remotely manipulating the pump units. The power units are provided respectively in at least two channels which include a spare channel.

U.S. Pat. No. 4,362,117, which issued to Mishina on Dec. 7, 1982, describes a marine steering gear with emergency steering means. A marine steering gear is equipped with an emergency steering means which comprises an emergency directional control valve capable of replenishing hydraulic fluid or oil to a plurality of pressure chambers of an actuator for a hydraulic steering engine through check valves and stop valves, and a relief valve designed to set a desired charge pressure and installed in lines of oil to be supplied through the directional control valve, check valves, and stop valves so as to forcibly reduce the air volumes in the pressure chambers and thereby hold the rudder blades substantially in a hydraulically locked state.

U.S. Pat. No. 4,431,422, which issued to Hall on Feb. 14, 1984, describes a marine hydraulic steering system control unit for a marine installation. It comprises a helm station including a pump comprising first and second pump discharge ports, which pump is selectively and alternatively operable to deliver fluid under pressure from the first and second pump discharge ports.

U.S. Pat. No. 4,578,039, which issued to Hall on Mar. 25, 1986, describes a marine hydraulic steering system control for a marine installation comprising a helm station including a pump comprising first and second pump discharge ports.

U.S. Pat. No. 6,406,340, which issued to Fetchko et al. on Jun. 18, 2002, describes a twin outboard motor hydraulic steering system. The assembly applies a force to tiller arms of twin marine outboard propulsion units and rotates the propulsion units about a steering axis between a center position and hard over positions to each side of the center position. A tie bar is pivotally connected to the steering apparatus and pivotally connected to the tiller arm of a second propulsion unit. The tie bar may be pivotally connected to the steering apparatus by a ball joint connected to the steering apparatus by a bracket which moves with the member.

U.S. Pat. No. 6,913,497, which issued to Ahlswede et al. on Jul. 5, 2005, discloses a tandem connection system for two or more marine propulsion devices. The connection system is intended for connecting two or more marine propulsion devices together and provides a coupler that can be rotated in place, without detachment from other components, to adjust the distances between the tie bar arms. In addition, the use of various clevis ends and pairs of attachment plates on the components significantly reduces the possibility of creating moments when forces and their reactions occur between the various components.

U.S. patent application Ser. No. 10/873,086 (M09811), which was filed by Lokken et al. on Jun. 21, 2004, discloses a connection device for a marine propulsion system. A selective locking mechanism automatically connects or disconnects two components of the marine propulsion system together in response to rotation of a tube and a rod. This relative rotation of the tube and rod is caused automatically when one of the components of the marine propulsion system is rotated relative to the other component.

U.S. patent application Ser. No. 11/248,483 (M09993), which was filed on Oct. 12, 2005 by Bradley et al., discloses a method for positioning a marine vessel. The vessel positioning system maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change of the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. patent application Ser. No. 11/248,482 (M09992), which was filed by Bradley et al. on Oct. 12, 2005, discloses a method for maneuvering a marine vessel in response to a manually operable control device. A marine vessel is maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel. The internal combustion engines are provided to drive the marine propulsion devices. The steering axes of the two marine propulsion devices are generally vertical and parallel to each other. The two steering axes extend through a bottom surface of the hull of the marine vessel.

U.S. Pat. No. 5,755,605, which issued to Äsberg on May 26, 1998, describes a propeller drive unit. Installation in a boat has two propeller drive units which extend out through individual openings in the bottom of a V-bottomed boat, so that the legs are inclined relative to each other. The leg of one drive unit can be set to turn the boat in one direction at the same time as the leg of the other drive unit can be set to turn the boat in the opposite direction, so that the horizontal counteracting forces acting on the legs cancel each other, while the vertical forces are added to each other to trim the running position of the boat in the water.

U.S. Pat. No. 6,234,853, which issued to Lanyi et al. on May 22, 2001, discloses a simplified docking method and apparatus for a multiple engine marine vessel. A docking system is provided which utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking and maneuvering system uses two marine propulsion units to respond to an operator's command signal and allows the operator to select forward or reverse commands in combination with clockwise or counterclockwise rotational commands either in combination with each other or alone.

International Patent Application WO 03/042036, which was filed by Arvidsson on Nov. 8, 2002, describes a remote control system for a vehicle. It comprises a primary heading sensor fixedly attached to the vehicle, the primary heading sensor being adapted to detect a reference heading, a remote control unit comprising a steering input manipulator, the remote control unit being either portable by a user or rotationally attached to the vehicle relative to a marine axis of the vehicle, the remote control unit being adapted to communicate steering input data to a steering computer programmed to process the steering input data into steering commands and to communicate the steering commands to a steering mechanism of the vehicle. The remote control unit comprises a secondary heading sensor which is synchronized with the primary heading sensor with respect to the reference heading, and the steering input data includes information of an active position of the steering input manipulator relative to the reference heading, the active position of the steering input manipulator determining the desired direction of travel of the vehicle regardless of the orientation of the remote control unit relative to the main axis of the vehicle.

International Patent Application WO 03/093102, which was filed by Arvidsson et al. on Apr. 29, 2003, describes a method of steering a boat with double outboard drives and a boat having double outboard drives. The method of steering a planing V-bottomed boat with double individually steerable outboard drive units with underwater housings, which extend down from the bottom of the boat, is described. When running at planing speed straight ahead, the underwater housings are set with "toe-in" (i.e. inclined toward each other with opposite angles of equal magnitude relative to the boat centerline). When turning, the inner drive unit is set with a greater steering angle than the outer drive unit.

U.S. Pat. No. 6,431,928, which issued to Aarnivuo on Aug. 13, 2002, describes an arrangement and method for turning a propulsion unit. The propeller drive arrangement includes an azimuthing propulsion unit, a power supply, a control unit, and a sensor means. An operating means is provided for turning the azimuthing propulsion unit in relation to the hull of the vessel for steering the vessel in accordance with a steering command controlled by the vessel's steering control device. The operating means also includes a second electric motor for turning the azimuthing propulsion unit via a mechanical power transmission that is connected to the second electric motor.

U.S. Pat. No. 6,623,320, which issued to Hedlund on Sep. 23, 2003, describes a drive means in a boat. A boat propeller drive with an underwater housing which is connected in a fixed manner to a boat hull and has tractor propellers arranged on that side of the housing facing ahead is described. Arranged in that end portion of the underwater housing facing astern is an exhaust discharge outlet for discharging exhaust gases from an internal combustion engine connected to the propeller drive.

U.S. Pat. No. 6,712,654, which issued to Putaansuu on Mar. 30, 2004, describes a turning of a propulsion unit. The arrangement for moving and steering a vessel includes a propulsion unit having a chamber positioned outside the vessel equipment for rotating a propeller arranged in connection with the chamber, and a shaft means connected to the chamber for supporting the chamber in a rotatable manner at the hull of the vessel. At least one hydraulic motor is used for turning the shaft means in relation to the hull of the vessel for steering the vessel. The arrangement also includes means for altering the rotational displacement of the hydraulic engine.

The patents described above are hereby expressly incorporated by reference in the description of the present invention.

When two or more marine propulsion devices are independently rotatable about their respective steering axes, it would be significantly beneficial if the marine propulsion devices could be selectively locked to each other for synchronous rotation about their axes or, alternatively, allowed to rotate independently about their individual axes in order to allow an improved degree of maneuverability of the associated marine vessel, especially when the marine vessel is being maneuvered into a docking space.

SUMMARY OF THE INVENTION

A marine vessel steering system made in accordance with a preferred embodiment of the present invention comprises a first marine propulsion device attached to the marine vessel and a second marine propulsion device attached to the marine vessel. A first actuator is connected to the first marine propulsion device to cause the first marine propulsion device to rotate about a first axis. A second actuator is connected to the second marine propulsion device to cause the second marine propulsion device to rotate about a second axis. A connecting link is attached between the first and second marine propulsion devices. The connecting link has a first selectable condition and a second selectable condition. The first and second marine propulsion devices are generally locked in synchronous rotation with each other when the connecting link is in the first selectable condition and the first and second marine propulsion devices are generally able to rotate independently from each other when the connecting link is in the second selectable condition.

In a preferred embodiment of the present invention, the first and second axes extend through a submerged hull surface of the marine vessel. The connecting link comprises a hydraulic apparatus having a cylinder, a piston disposed within the cylinder and a piston rod attached to the piston. The cylinder is attached to the first marine propulsion device and the piston rod is attached to the second marine propulsion device. A locking valve is connected in fluid communication between the first and second sides of the piston of the connecting link. The locking valve has a first state and a second state. The first state causes the connecting link to be in the first selectable condition and the second state causes the connecting link to be the in the second selectable condition.

In a preferred embodiment of the present invention, it further comprises a microprocessor connected in signal communication with the locking valve and configured to selectively place the connecting link in the first and second selectable conditions. The first actuator and the second actuator can comprise, respectively, a first hydraulic actuator and a second hydraulic actuator. A preferred embodiment of the present invention can further comprise first and second valves which are connected in fluid communication with the first and second hydraulic actuators, respectively, and configured to selectively place their associated hydraulic actuator in alternative locked and unlocked states. The first and second hydraulic actuators, respectively, are prevented from actuating the first and second marine propulsion devices, respectively, when in the locked state and the first and second hydraulic actuators, respectively, are permitted to actuate the first and second marine propulsion devices, respectively, when in the unlocked state.

The present invention, in a preferred embodiment, can further comprise a microprocessor connected in signal communication with the connecting link and configured to selectively place the connecting link in the first and second selectable conditions.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
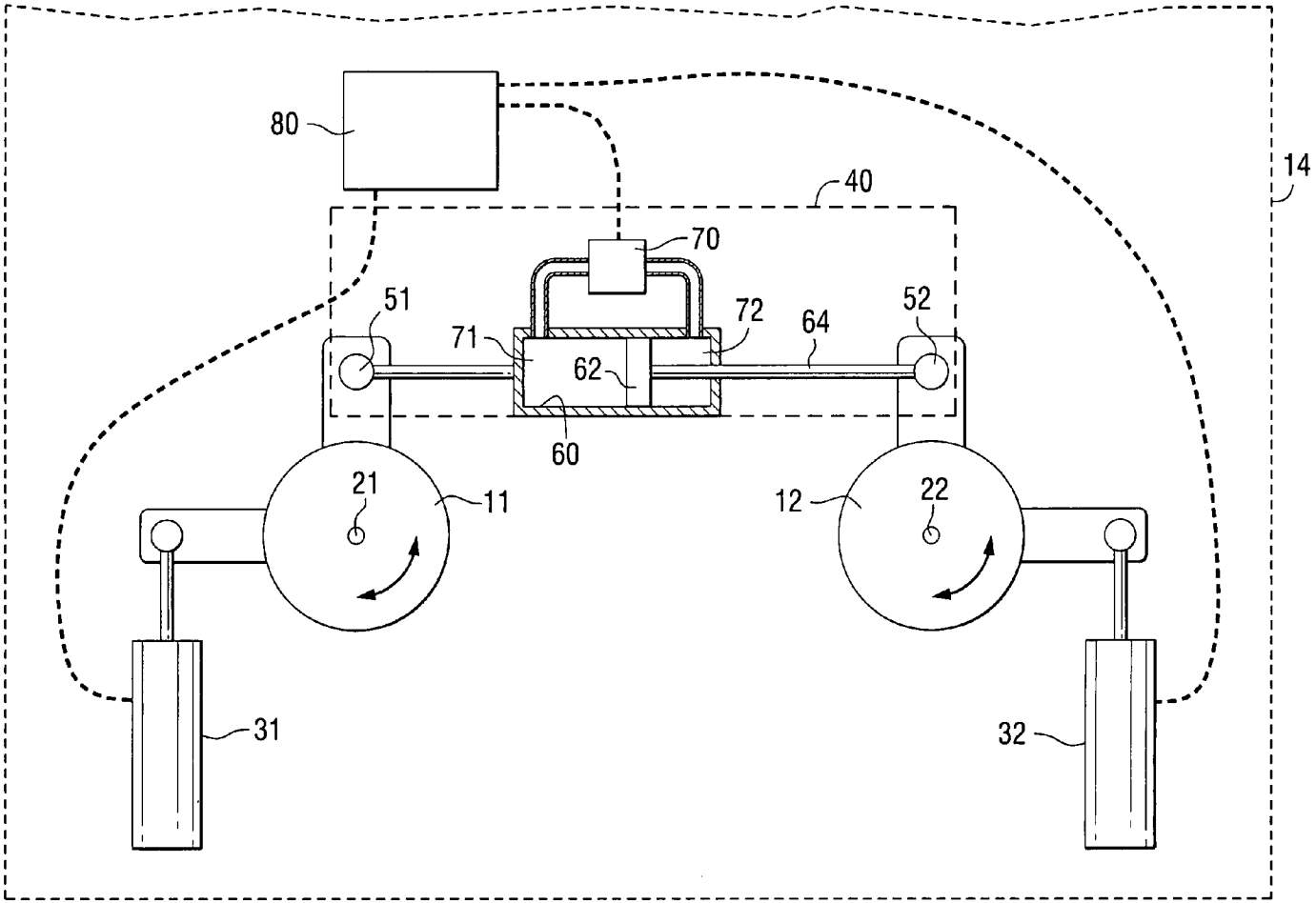
FIG. 1 is a simplified schematic representation of the present invention.

Throughout the description of the preferred embodiment of the present invention, like components will be identified by like reference numerals.

Figure 2:
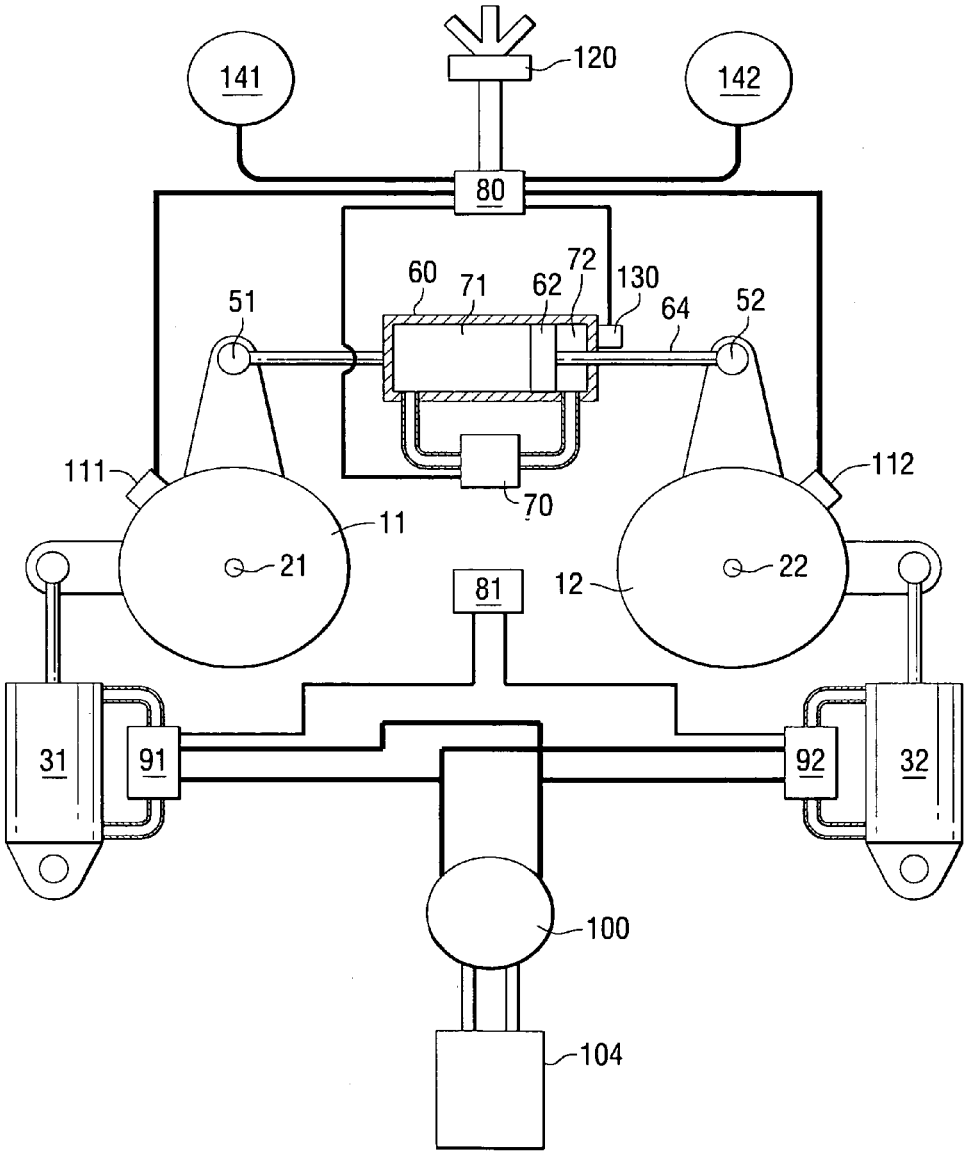
FIG. 2 is a more detailed schematic representation of the present invention.

FIG. 1 is a simplified representation of the present invention which is provided to facilitate an explanation of its basic components. FIG. 2 is a more detailed schematic representation of the present invention.

In FIG. 1, first and second marine propulsion devices, 11 and 12, are shown in conjunction with a marine vessel 14 which is represented by dashed lines. The first and second marine propulsion devices, 11 and 12, are attached to the marine vessel 14 and supported for rotation about first and second axes, 21 and 22, respectively. A first actuator 31 is connected to the first marine propulsion device 11 to cause the first marine propulsion device to rotate about the first axis 21. Similarly, a second actuator 32 is connected to the second marine propulsion device 12 to cause the second marine propulsion device to rotate about the second axis 22. The illustrated first and second actuators, 31 and 32, in FIG. 1 are shown as hydraulic cylinders. The first and second marine propulsion devices, 11 and 12, are rotatable as indicated by the arrows associated with those two components. A connecting link 40 is represented within the dashed box in FIG. 1 and is attached between the first and second marine propulsion devices, 11 and 12. The connecting link 40 has a first selectable condition and a second selectable condition. The first and second marine propulsion devices, 11 and 12, are locked in synchronous rotation with each other when the connecting link 40 is in the first selectable condition. The first and second marine propulsion devices, 11 and 12, are generally able to rotate independently from each other, about their respective axes, when the connecting link 40 is in the second selectable condition. The pivot points identified by reference numerals 51 and 52 are movable relative to each other when the connecting link 40 is in the second selectable condition. As a result, the first and second marine propulsion devices, 11 and 12, can rotate about their respective axes, 21 and 22, when the connecting points, 51 and 52, are able to move relative to each other. However, when the connecting link 40 is in the first selectable condition, points 51 and 52 are fixed in position relative to each other and the first and second marine propulsion devices, 11 and 12, must rotate in synchrony with each other.

As illustrated in FIG. 1, the first and second axes, 21 and 22, extend through a submerged hull surface of the marine vessel 14. This type of marine propulsion system is described in detail in several of the patents identified above and will not be described in detail herein.

With continued reference to FIG. 1, the connecting link 40 comprises a hydraulic apparatus having a cylinder 60, a piston 62 disposed within the cylinder 60, and a piston rod 64 attached to the piston 62. The cylinder 60 is attached to the first marine propulsion device 11, at link position 51, and the piston rod 64 is attached to the second marine propulsion device 12, at the point identified by reference numeral 52. A locking valve 70 is connected in fluid communication between first and second sides, 71 and 72, of the piston 62 of the connecting link 40. The locking valve 70 has a first state and a second state. The first state causes the connecting link 40 to be in the first selectable condition, requiring synchronous rotation of the first and second marine propulsion devices, 11 and 12. The second state causes the connecting link 40 to be in the second selectable condition, in which the first and second marine propulsion devices, 11 and 12, are free to rotate independently from each other. When the locking valve 70 is opened, in its second state, hydraulic fluid is free to move from the first side 71 to the second side 72 of the piston 62. This allows free movement of the piston rod 64 relative to the cylinder 60 and, as a result, allows free movement between connecting points 51 and 52. When the locking valve 70 is in a closed position, hydraulic fluid is not free to move from one side of the piston 62 to the other. As a result, the piston rod 64 is not free to move relative to the cylinder 60 and, as a result, connecting points 51 and 52 are in a fixed position relative to each other and this condition requires synchronous rotation of the first and second marine propulsion devices, 11 and 12.

With continued reference to FIG. 1, a microprocessor 80 is connected in signal communication with the first and second actuators, 31 and 32, and the locking valve 70. These connections are represented by dashed lines in FIG. 1. This allows the microprocessor 80 to actuate the first and second actuators, 31 and 32, to accomplish steering maneuvers of the marine vessel 14. In addition, the microprocessor 80 is able to select the state of the locking valve 70.

The first and second marine propulsion devices, 11 and 12, can be locking in synchrony with each other to provide a significant beneficial characteristic in the event that either one of the first and second actuators, 31 and 32, is disabled. By locking the first and second marine propulsion devices to each other, through the use of the locking valve 70, one of the actuators, 31 or 32, can be used to accomplish the required steering maneuvers even though the other actuator is disabled. Alternatively, for docking maneuvers, the connecting link 40 can be placed in the second selectable condition to facilitate intricate maneuvers of the marine vessel 14 that can only be accomplished through the independent rotation of the first and second marine propulsion devices, 11 and 12, about their respective axes, 21 and 22.

FIG. 2 is a more detailed illustration of the present invention. In addition to the components described above in conjunction with FIG. 1, FIG. 2 shows a first valve 91 and a second valve 92. These two valves, respectively, are connected in fluid communication with the first and second actuators, 31 and 32. They are configured to selectively place their associated hydraulic actuator in alternative locked and unlocked states. When in the locked state, the associated hydraulic actuator, 31 or 32, is prevented from actuating its associated marine propulsion device, 11 or 12. When in the unlocked state, the associated hydraulic actuator, 31 or 32, is permitted to actuate the associated marine propulsion device to cause it to rotate about its respective axis, 21 or 22. In this way, the first and second valves, 91 and 92, operate with respect to their associated hydraulic actuators, 31 and 32, in a manner generally similar to the way that the locking valve 70 operates in conjunction with the connecting link 40 described above in conjunction with FIG. 1.

FIG. 2 also shows a helm position 100 which provides a steering wheel that directs hydraulic fluid to and from the first and second actuators, 31 and 32. A power unit 104, such as a pump, is used to induce the flow of that fluid. An additional microprocessor symbol 81 is shown in FIG. 2. This represents a portion of the programming of the microprocessor which is directed to the control of the first and second valves, 91 and 92. It should be understood that the microprocessor portions identified by reference numerals 80 and 81 can likely be different programs in a common microprocessor.

Position sensors 111 and 112 are monitored by the microprocessor 80 to maintain an indication of the steering positions of the first and second marine propulsion devices, 11 and 12, respectively. In addition, a switch 120 is provided to allow an operator of the marine vessel to place the steering system in a docking mode. When in the docking mode, it is typically desirable to allow the first and second marine propulsion devices, 11 and 12, to rotate independently from each other. Therefore, the connecting link 40 described above in conjunction with FIG. 1 would be placed in the second selectable condition to permit this independent rotation of the first and second marine propulsion devices about their axes, 21 and 22, respectively.

A position sensor 130 is provided to allow the microprocessor 80 to determine the position of the piston 62 within the cylinder 60. Although the piston 62 is illustrated toward one side of the cylinder 60 in FIG. 2, it should be understood that a typical application of the present invention would possibly place the piston 62 in the middle position of the cylinder 60 when the first and second marine propulsion devices, 11 and 12, are both centered as illustrated in FIG. 2. Devices 141 and 142 in FIG. 2 represent visual illustrations that can be provided to the operator of the marine vessel to indicate the current positions of the first and second marine propulsion devices, 11 and 12, about their respective axes, 21 and 22.

With reference to FIGS. 1 and 2, the provision of the connecting link 40 allows the first and second marine propulsion devices, 11 and 12, to be rotated either in synchrony with each other or independently from one another. If the first or second actuator, 31 or 32, becomes disabled or inoperative, both marine propulsion devices, 11 and 12, can be actuated by the other actuator. This is accomplished by placing the connecting link 40 in its first state to rigidly lock the two marine propulsion devices together. Alternatively, the connecting link 40 can be placed in the second state to allow independent rotation of the first and second marine propulsion devices, 11 and 12, about their respective axes, 21 and 22. This allows more accurate maneuvering of the marine vessel.

Although the present invention has been described with particular specificity and illustrated to show a preferred embodiment, it should be understood that alternative embodiments are also within its scope.

I claim:

1. A marine vessel steering system, comprising:

a first marine propulsion device attached to said marine vessel and supported for rotation about a first steering axis;

a second marine propulsion device attached to said marine vessel and supported for rotation about a second steering axis;

a first actuator connected to said first marine propulsion device to cause said first marine propulsion device to rotate about said first steering axis;

a second actuator connected to said second marine propulsion device to cause said second marine propulsion device to rotate about said second steering axis; and a connecting link attached between said first and second marine propulsion devices, said connecting link having a first hydraulically selectable condition and a second hydraulically selectable condition, whereby said first and second marine propulsion devices are generally locked in synchronous rotation with each other when said connecting link is in said first hydraulically selectable condition and said first and second marine propulsion devices are generally able to rotate independently from each other when said connecting link is in said second hydraulically selectable condition.

2. The system of claim 1, wherein:

said first and second axes are both generally vertical and extend through a submerged hull surface of said marine vessel.

3. The system of claim 2, wherein:

said connecting link comprises a hydraulic apparatus having a cylinder, a piston disposed within said cylinder and a piston rod attached to said piston, said cylinder being attached to said first marine propulsion device and said piston rod being attached to said second marine propulsion device.

4. The system of claim 3, further comprising:

a locking valve connected in fluid communication between first and second sides of said piston of said connecting link, said locking valve having a first state and a second state, said first state causing said connecting link to be in said first hydraulically selectable condition, said second state causing said connecting link to be in said second hydraulically selectable condition.

5. The system of claim 4, further comprising:

a microprocessor connected in signal communication with said locking valve and configured to selectively place said connecting link in said first and second hydraulically selectable conditions.

6. The system of claim 1, wherein:

said first actuator comprises a first hydraulic actuator; and said second actuator comprises a second hydraulic actuator.

7. The system of claim 6, further comprising:

a first valve connected in fluid communication with said first hydraulic actuator and configured to selectively place said first hydraulic actuator in alternative locked and unlocked states, said first hydraulic actuator being prevented from actuating said first marine propulsion device when in said locked state and said first hydraulic actuator being permitted to actuate said first marine propulsion device when in said unlocked state; and a second valve connected in fluid communication with said second hydraulic actuator and configured to selectively place said second hydraulic actuator in alternative locked and unlocked states, said second hydraulic actuator being prevented from actuating said second marine propulsion device when in said locked state and said second hydraulic actuator being permitted to actuate said second marine propulsion device when in said unlocked state.

8. The system of claim 1, further comprising:

a microprocessor connected in signal communication with said connecting link and configured to selectively place said connecting link in said first and second hydraulically selectable conditions.

9. A marine vessel steering system, comprising:

a first marine propulsion device attached to said marine vessel;

a second marine propulsion device attached to said marine vessel;

a first actuator connected to said first marine propulsion device to cause said first marine propulsion device to rotate about a first axis;

a second actuator connected to said second marine propulsion device to cause said second marine propulsion device to rotate about a second axis, said first and second axes extending vertically through a submerged hull surface of said marine vessel; and a connecting link attached between said first and second marine propulsion devices, said connecting link having a first selectable condition and a second selectable condition, whereby said first and second marine propulsion devices are generally locked in synchronous rotation with each other when said connecting link is in said first selectable condition and said first and second marine propulsion devices are generally able to rotate independently from each other when said connecting link is in said second selectable condition.

10. The system of claim 9, wherein:

said connecting link comprises a hydraulic apparatus having a cylinder, a piston disposed within said cylinder and a piston rod attached to said piston, said cylinder being attached to said first marine propulsion device and said piston rod being attached to said second marine propulsion device.

11. The system of claim 10, further comprising:

a locking valve connected in fluid communication between first and second sides of said piston of said connecting link, said locking valve having a first state and a second state, said first state causing said connecting link to be in said first selectable condition, said second state causing said connecting link to be in said second selectable condition; and a microprocessor connected in signal communication with said locking valve and configured to selectively place said connecting link in said first and second selectable conditions.

12. The system of claim 11, further comprising:

a first valve connected in fluid communication with said first hydraulic actuator and configured to selectively place said first hydraulic actuator in alternative locked and unlocked states, said first hydraulic actuator being prevented from actuating said first marine propulsion device when in said locked state and said first hydraulic actuator being permitted to actuate said first marine propulsion device when in said unlocked state; and a second valve connected in fluid communication with said second hydraulic actuator and configured to selectively place said second hydraulic actuator in alternative locked and unlocked states, said second hydraulic actuator being prevented from actuating said second marine propulsion device when in said locked state and said second hydraulic actuator being permitted to actuate said second marine propulsion device when in said unlocked state.

* * * * *